United States Patent [19]

Tomlinson

[11] Patent Number: 4,880,278

[45] Date of Patent: Nov. 14, 1989

[54] CUTTING TOOL FOR A MINING MACHINE

[76] Inventor: Peter N. Tomlinson, 315 Enford Road, Mondeor, Transvaal, South Africa

[21] Appl. No.: 134,925

[22] Filed: Dec. 18, 1987

[30] Foreign Application Priority Data

Dec. 19, 1986 [ZA] South Africa ..... 86/9564

[51] Int. Cl.[4] ..... E21C 35/18; E21B 10/46

[52] U.S. Cl. ..... 299/79; 175/329; 175/410; 175/413

[58] Field of Search ..... 299/79, 86, 91; 175/410, 413, 329; 407/118, 119

[56] References Cited

U.S. PATENT DOCUMENTS

| | | | |
|---|---|---|---|
| 3,342,532 | 9/1967 | Krekeler | 175/410 X |
| 4,337,980 | 7/1982 | Krekeler | 299/91 |
| 4,655,508 | 4/1987 | Tomlinson | 299/79 |
| 4,678,237 | 7/1987 | Collin | 299/79 |
| 4,679,858 | 7/1987 | Tank | 299/91 |

FOREIGN PATENT DOCUMENTS

| | | | |
|---|---|---|---|
| 2849711 | 6/1979 | Fed. Rep. of Germany | 299/91 |

*Primary Examiner*—Hoang C. Dang

*Attorney, Agent, or Firm*—Scully, Scott, Murphy & Presser

[57] ABSTRACT

A cutting tool for a mining machine comprises a holding lug for connecting the tool to the mining machine, and a tool component. The tool component comprises a cemented carbide stud having a bottom portion, a top conical portion in which is provided a top recess and a central portion spacing the top portion from the bottom portion. The bottom portion and the whole of the central portion are secured within a socket formed in one end of the holding lug. The top conical portion lies wholly within the space bounded by an imaginary upward continuation of the upper edge of the end of the holding lug. The tool component also includes a composite abrasive compact secured within the top recess, the composite abrasive compact comprising a cemented carbide backing to which is bonded a compact layer. The periphery of the compact layer provides a cutting edge for the tool component.

4 Claims, 2 Drawing Sheets

CUTTING TOOL FOR A MINING MACHINE

BACKGROUND OF THE INVENTION

This invention relates to a cutting tool for a mining machine for cutting a variety of soft materials such as coal.

Cutting tools of this type comprise a holding lug and an insert secured in a bore or socket in the lug. A plurality of the cutting tools are positioned on a working surface, for example on the surface of a drum, and moved in a cutting direction against the face of the material to be cut.

The insert which is secured in the socket or bore in the lug will preferably contain abrasive compact as the cutting edge. In one known embodiment, that described in U.S. Pat. No. 4,655,508, the insert comprises an elongate cemented carbide stud, a recess formed in one end of the stud, the stud having surfaces sloping away from the recess to provide a shoulder which completely surrounds the recess and a complete abrasive compact or an abrasive compact located in the recess and bonded to the stud and presenting an abrasive compact cutting edge or surface. When the insert is located in the socket in the lug the shoulder provides a protective surface of the area of the lug around the socket acting to deflect material being cut away from the lug. The life of the lug which is made of steel, is thus prolonged. While an insert of the type described above has been found to work well and achieves its objective for soft coals, problems do arise when the insert is used for cutting harder coals. The extensive surface area of the shoulder places great mechanical stress on the insert and fracture of the holding lug or dislodgement of the insert itself from the lug can occur.

U.S. Pat. No. 4,678,237 describes a stud for use in a mining pick which has a tip consisting of polycrystalline diamond composite and a body having a carrying surface on which the tip is mounted, the carrying surface being inclined to the axis of the body at an angle between 45° and 65°. The stud is received within a pocket in the head of a mining pick, the axis of the pick and the axis of the stud being substantially coincident.

SUMMARY OF THE INVENTION

According to the invention, a cutting tool for a mining machine comprises: a holding lug for connecting the tool to the mining machine, and including a first end portion defining an upper edge within which is located a socket; and a tool component including:

(a) a cemented carbide stud including a bottom portion, a top conical portion having a top recess and a central portion spacing the top portion from the bottom portion, (b) the bottom portion and the whole of the central portion being secured within the socket to connect the tool component to the holding lug, (c) the top conical portion lying wholly within the space bounded by an imaginary upward continuation of the upper edge of the first end portion of the socket, and (d) a composite abrasive compact or abrasive compact secured within the top recess, extending outward therefrom and forming an abrasive compact surface, the periphery of which provides a cutting edge.

Further according to the invention there is provided a method of cutting a coal surface, the coal having an unconfined compressive strength of at least 20 mPa, including the step of attacking the surface with the cutting edge of a cutting tool of the type described above.

DESCRIPTION OF AN EMBODIMENT OF THE INVENTION

Figure 1:
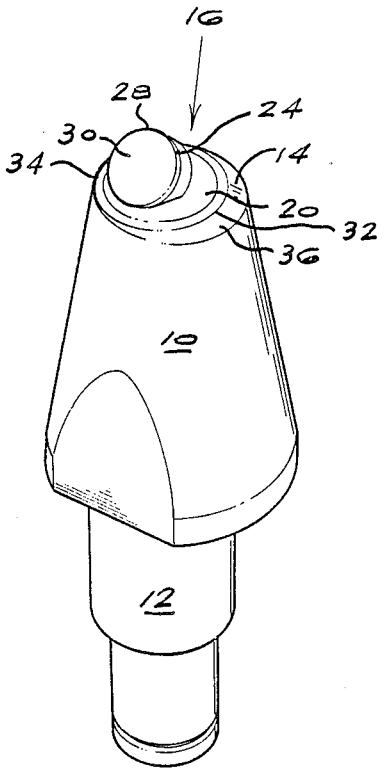
FIG. 1 illustrates a perspective view of an embodiment of the invention.

Referring to the drawings, there is shown a cutting tool for a mining machine comprising a holding lug 10, one end 12 of which is shaped for mounting in the drum surface of a conventional mining machine and the other end 14 of which is provided with a socket for receiving an insert or tool component 16. The tool component comprises a cemented carbide stud having a bottom portion 18 secured within the socket to connect the tool component to the holding lug, a top conical portion 20 and a central portion 22 connecting the top portion 20 with the bottom portion 18.

The top conical portion 20 has a top recess 23 formed therein. Located in this recess 23 is a composite abrasive compact which comprises an abrasive compact layer 24 bonded to a cemented carbide support or backing 26. The peripheral edge 28 of the top flat surface 30 of the abrasive compact provides a cutting edge for the tool. The composite abrasive compact may be any known in the art but is preferably a composite diamond abrasive compact.

Figure 2:
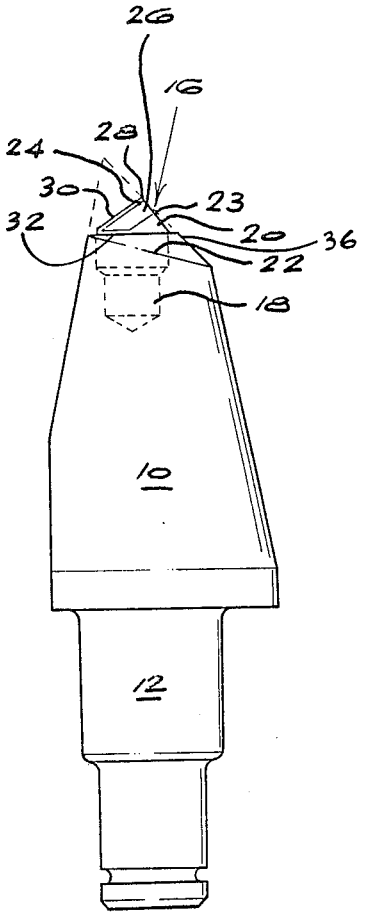
FIG. 2 illustrates a side view of the same embodiment.

There are several important features of the cutting tool. First, the top conical portion lies wholly within a space bounded by an imaginary upward continuation of a top frusto-conical tapered surface 36 of the holding, continuing upwardly from the top circular edge 32 of the holding lug (illustrated by dotted lines in FIG. 2). Second, the central connecting portion 22 lies wholly within the socket and together with the bottom portion 18 provides substantial brazing area and contact between the stud and the holding lug. These features are important when the cutting tool is used to cut hard coal, that is coal having an unconfined compressive strength of at least 20 mPa. It has been found that the more firmly embedded tool component better resists the mechanical stresses encountered during cutting of these coals and those which occur during movement of the tool component through the material which has already been cut. It has further been found the region of the holding lug at the end 14 and either side of the abrasive compact (see FIG. 1) wear during cutting. This, it has surprisingly been found, does not lead to any deterimental results. Indeed, once the wearing has taken place the cutting tool passes through the hard coal more easily and better cutting is achieved.

Bonding of the carbide stud of the tool component 16 to the holding lug 10 may be achieved by methods known in the art such as brazing, glueing, mechanical or a combination thereof.

Figure 3:
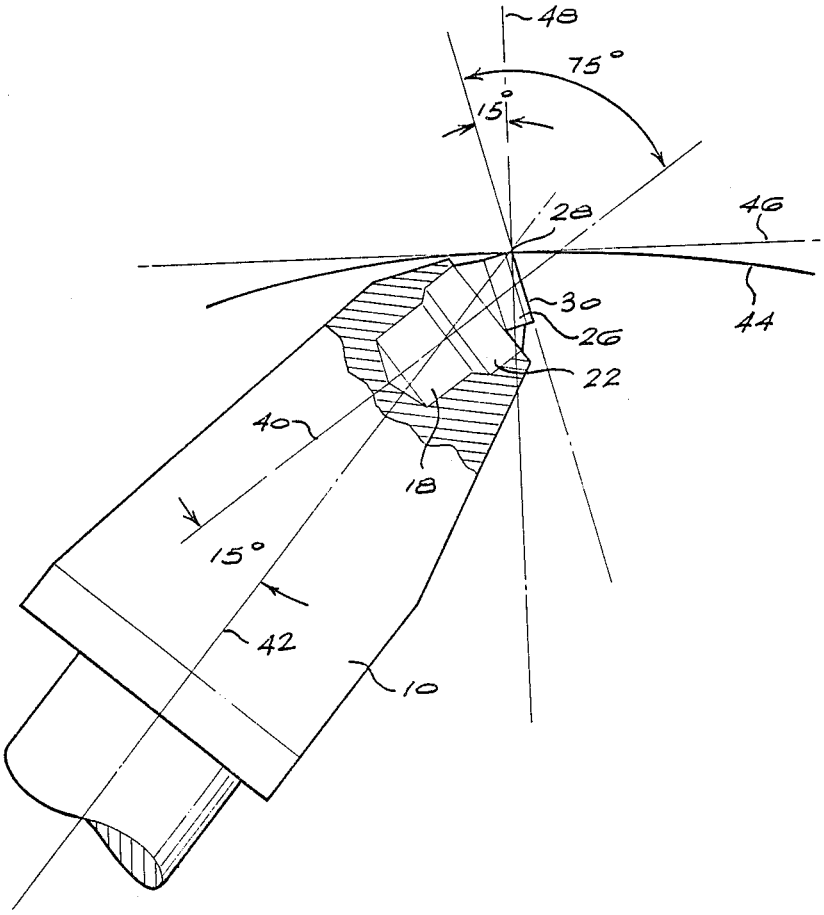
FIG. 3 illustrates a side view of a second embodiment of the invention.

A second embodiment of the invention is illustrated by FIG. 3. This embodiment is similar to that of the embodiment illustrated by FIGS. 1 and 2 and like parts carry like numerals. This embodiment differs from the other embodiments in that the axis 40 of the cemented carbide stud is offset relative to the axis 42 of the holding lug.

Curved line 44 is the path followed by the peripheral cutting edge 28 of the abrasive compact when attacking a coal or like surface. The tangent to this curve is shown by the line 46. The angle which the top surface 30 of the abrasive compact makes with the perpendicular 48 to tangent 46 is known as the "rake angle". The rake angle may be negative, as illustrated, or it may be positive in which event the angle will be on the opposite side of the perpendicular 48. In most cases, it is preferred that the rake angle is negative. Generally this angle will lie between 0° and 20°. For hard coals, the preferred rake angle is −15°.

As stated above the axis 40 of the stud is offset relative to the axis 42 of the lug. Generally the angle between the two axes will be between 10° and 35°. This has the advantage that the bending moment on the stud in use is less than if the axes are coincident or approximately coincident. In order to achieve a desired rake angle, the top recess 23 in the carbide stud will be provided at a suitable angle to ensure that the top surface 30 of the abrasive compact is at the desired rake angle.

Further, the angle between the axis 42 of the lug and the perpendicular 48 to the tangent 46, known as the pick angle of attack, is generally between 40° and 45°.

I claim:

1. A cutting tool for a mining machine, comprising a holding lug for connecting the tool to the mining machine, and including a first end portion defining a top frusto-conical tapered surface having an upper edge within which is located a socket; and a tool component including:

(a) a cemented carbide stud including a bottom portion, a top frusto-conical portion having a top recess, and a central portion spacing the top portion from the bottom portion, (b) the bottom portion and the whole of the central portion being secured within the socket to connect the tool component to the holding lug, (c) the top frusto-conical portion lying wholly and entirely within a space bounded by an imaginary upward continuation of the top frusto-conical tapered surface of the holding lug, continuing upwardly from the upper edge of the first end portion of the holding lug, and (d) a composite abrasive compact or abrasive compact secured within the top recess, extending outward therefrom and forming an abrasive compact surface, the periphery of which provides a cutting edge.

2. The cutting tool according to claim 1, wherein the cemented carbide stud has a central axis which is offset relative to a central axis of the first end portion of the holding lug.

3. The cutting tool according to claim 2, wherein the two central axes are positioned at an angle of between 10° and 35° relative to each other.

4. The cutting tool according to claim 1, wherein the composite abrasive compact is a composite diamond abrasive compact.

* * * * *